US009284080B2

(12) United States Patent
Neeser et al.

(10) Patent No.: US 9,284,080 B2
(45) Date of Patent: Mar. 15, 2016

(54) MOBILE STRAPPIING DEVICE

(75) Inventors: Mirco Neeser, Ennetbaden (CH); Roland Widmer, Bremgarten (CH); Flavio Finzo, Wuerenlos (CH)

(73) Assignee: Signode Industrial Group LLC, Glenview, IL (US)

( * ) Notice: Subject to any disclaimer, the term of this patent is extended or adjusted under 35 U.S.C. 154(b) by 815 days.

(21) Appl. No.: 12/989,142

(22) PCT Filed: Jan. 6, 2009

(86) PCT No.: PCT/CH2009/000002

§ 371 (c)(1), (2), (4) Date: Nov. 23, 2010

(87) PCT Pub. No.: WO2009/129634

PCT Pub. Date: Oct. 29, 2009

(65) Prior Publication Data

US 2011/0056390 A1 Mar. 10, 2011

(30) Foreign Application Priority Data

Apr. 23, 2008 (CH) ..... 0646/08

(51) Int. Cl.
*B65B 13/32* (2006.01)
*B65B 13/02* (2006.01)
*B65B 13/18* (2006.01)

(52) U.S. Cl.
CPC ..... *B65B 13/025* (2013.01); *B65B 13/187* (2013.01); *B65B 13/322* (2013.01)

(58) Field of Classification Search
CPC .... B65B 13/025; B65B 13/322; B65B 13/187
USPC ..... 100/29, 32, 33 PB, 30, 33 R
See application file for complete search history.

(56) References Cited

U.S. PATENT DOCUMENTS 3,367,374 A 2/1968 Meier et al.
3,654,033 A 4/1972 Angarola et al.

(Continued)

FOREIGN PATENT DOCUMENTS

CN 1253099 5/2000
CN 1558842 A 12/2004

(Continued)

OTHER PUBLICATIONS

ISR for PCT/CH2009/000002 mailed Jun. 22, 2009.

(Continued)

*Primary Examiner* — Jimmy T Nguyen
*Assistant Examiner* — Chwen-Wei Su
(74) *Attorney, Agent, or Firm* — Neal, Gerber & Eisenberg LLP

(57) ABSTRACT

Disclosed is a mobile strapping device for strapping packaged goods with wrap-around strap, including a tensioner for applying a strap tension to a loop of a wrapping strap, and a friction welder for producing a friction weld connection in two areas of the loop of the wrapping strap disposed one on top of the other, and a chargeable energy storage means for storing energy, in particular electrical, mechanical, elastic or potential energy, that can be released as drive energy at least for the friction welder for producing a friction weld connection. The strapping device is provided with a common drive for the tensioner for producing a tensioning motion, and for the friction welder for producing an oscillating friction welding motion and for a transitioning device for producing a transitioning motion of the friction welder from a rest position to a welding position.

23 Claims, 9 Drawing Sheets

(56) References Cited

U.S. PATENT DOCUMENTS

| | | | | |
|---|---|---|---|---|
| 4,011,807 | A | 3/1977 | Kobiella | |
| 4,015,643 | A | 4/1977 | Cheung | |
| 4,313,779 | A | 2/1982 | Nix | |
| 4,450,032 | A | 5/1984 | Wehr | |
| 4,572,064 | A | 2/1986 | Burton et al. | |
| 4,707,390 | A | 11/1987 | Cheung | |
| 4,776,905 | A | 10/1988 | Cheung et al. | |
| 5,133,532 | A | 7/1992 | Figiel et al. | |
| 5,146,847 | A | 9/1992 | Lyon et al. | |
| 5,155,982 | A * | 10/1992 | Boek et al. | 53/589 |
| 5,159,218 | A | 10/1992 | Murry et al. | |
| 5,516,022 | A | 5/1996 | Annis, Jr. | |
| 5,689,943 | A | 11/1997 | Wehr | |
| 5,690,023 | A * | 11/1997 | Stamm et al. | 100/29 |
| 5,798,596 | A * | 8/1998 | Lordo | 310/216.016 |
| 5,809,873 | A | 9/1998 | Chak et al. | |
| 6,003,578 | A | 12/1999 | Chang | |
| 6,109,325 | A | 8/2000 | Chang | |
| 6,308,760 | B1 * | 10/2001 | Finzo et al. | 156/494 |
| 6,332,306 | B1 | 12/2001 | Finzo et al. | |
| 6,405,766 | B1 | 6/2002 | Benjey | |
| 6,516,715 | B1 | 2/2003 | Reiche | |
| 6,578,337 | B2 | 6/2003 | Scholl et al. | |
| 6,606,766 | B2 | 8/2003 | Ko | |
| 6,644,713 | B2 | 11/2003 | Del Pozo Abejon et al. | |
| 6,715,375 | B2 | 4/2004 | Nestler | |
| 6,732,638 | B1 | 5/2004 | Rometty et al. | |
| 6,817,159 | B2 * | 11/2004 | Sakaki et al. | 53/399 |
| 6,918,235 | B2 | 7/2005 | Nix | |
| 7,011,000 | B2 | 3/2006 | Kushida et al. | |
| 7,249,862 | B2 | 7/2007 | Shirane | |
| 7,312,609 | B2 | 12/2007 | Schmollngruber et al. | |
| 7,456,608 | B2 | 11/2008 | Kageler et al. | |
| 8,198,839 | B2 | 6/2012 | Katou et al. | |
| 8,378,600 | B2 | 2/2013 | Katou et al. | |
| 2002/0100146 | A1 | 8/2002 | Ko | |
| 2002/0129717 | A1 * | 9/2002 | Helland et al. | 100/32 |
| 2003/0145900 | A1 | 8/2003 | Jensen et al. | |
| 2005/0279198 | A1 * | 12/2005 | Kushida et al. | 81/469 |
| 2006/0108180 | A1 * | 5/2006 | Grach et al. | 184/105.2 |
| 2006/0192527 | A1 | 8/2006 | Kageler et al. | |
| 2009/0013656 | A1 | 1/2009 | Nasiatka et al. | |
| 2012/0160364 | A1 | 6/2012 | Katou et al. | |

FOREIGN PATENT DOCUMENTS

| | | | |
|---|---|---|---|
| CN | 1859999 | | 11/2006 |
| CN | 201411061 | | 2/2010 |
| DE | 19751861 | | 1/1999 |
| DE | 10026200 | | 11/2001 |
| DE | 20321137 | U1 | 1/2006 |
| EP | 0480627 | A1 | 4/1992 |
| EP | 0744343 | | 11/1996 |
| EP | 0949146 | | 10/1999 |
| EP | 0997377 | | 5/2000 |
| EP | 0999133 | A1 | 5/2000 |
| EP | 1316506 | A1 | 6/2003 |
| EP | 1413519 | A1 * | 4/2004 |
| JP | S5290398 | A | 7/1977 |
| JP | S541238 | | 1/1979 |
| JP | S5638220 | A | 4/1981 |
| JP | S6322320 | A | 1/1988 |
| JP | H05198241 | | 8/1993 |
| JP | H07300108 | | 10/1996 |
| JP | H08324506 | A | 12/1996 |
| JP | H09283103 | A | 10/1997 |
| JP | 3044132 | | 5/2000 |
| JP | 2000128113 | A | 5/2000 |
| JP | 2000128115 | A | 5/2000 |
| JP | 3227693 | | 11/2001 |
| JP | 3242081 | | 12/2001 |
| JP | 2002235830 | A | 8/2002 |
| JP | 2003170906 | | 6/2003 |
| JP | 2003231291 | A | 8/2003 |
| JP | 2003348899 | A | 12/2003 |
| JP | 2004108593 | | 4/2004 |
| JP | 3548622 | | 7/2004 |
| JP | 2004241150 | | 8/2004 |
| JP | 2004323111 | | 11/2004 |
| JP | 2007276042 | A | 10/2007 |
| JP | 4406016 | | 1/2010 |
| KR | 840002211 | | 12/1984 |
| KR | 20000029337 | | 5/2000 |
| RU | 1772784 | C | 10/1992 |
| RU | 2118277 | C1 | 8/1998 |
| RU | 2161773 | | 1/2001 |
| RU | 2004115639 | A | 1/2006 |
| RU | 2355281 | | 5/2009 |
| SU | 1134117 | A3 | 1/1985 |
| WO | 2006048738 | | 5/2006 |
| WO | WO 2007/116914 | | 10/2007 |
| WO | WO 2009/129633 | | 10/2009 |
| WO | WO 2009/129636 | | 10/2009 |

OTHER PUBLICATIONS

Brushless DC Motor Drives, by Ali Emandi, in Energy-Efficient Electrical Motors, 3rd ed., Aug. 2004, ¶. 270-272, CRC Press & Marcel Dekker.

Lithium ion technology: shaping power tool. By Bender, in Air conditioning, heating, and refrigeration news. vol. 228, Issue 14, p. 18 Jul. 31, 2006.

Korean Office Action dated May 18, 2015 for Korean Application No. 10-2010-7023729 (8 pages).

* cited by examiner

MOBILE STRAPPIING DEVICE

RELATED APPLICATIONS

The present application is national phase of International Application Number PCT/CH2009/000002 filed Jan. 6, 2009, and claims priority from, Swiss Application Number 646/08 filed Apr. 23, 2008.

The invention relates to a mobile strapping device for strapping packaged goods with a wrap-around strap, comprising a tensioner for applying a strap tension to a loop of a wrapping strap, as well as a friction welder for producing a friction weld connection at two areas of the loop of wrapping strap disposed one on top of the other, and a chargeable energy storage means for storing energy, more particularly electrical, elastic or potential energy, that can be released as drive energy at least for the friction welder for producing a friction weld connection.

Such strapping devices have a tensioner, with which sufficiently great strap tension can be applied to a loop of strapping placed around the packaged goods. By means of preferably one clamping device of the strapping device the strap loop can then affixed to the packaged good for the following connection procedure. In strapping device of this type the connection procedure takes place by way of a friction welder. The pressure and the heat produced by the movement briefly locally melt the strap which generally contains a plastic. This produces a durable connection between the two strap layers which can only be broken with a large amount of force.

Strapping devices of this type are envisaged for mobile use, whereby the devices are taken by a user to the deployment site and should not be reliant on the use of externally supplied energy. In previously known strapping devices the energy required for the intended use of such strapping devices for strapping a wrapping strap around any type of packed goods and for producing the connection, is generally provided by an electrical storage battery or by compressed air. With this energy the strap tension applied to the strap by the tensioner and the connection on the strap are produced. Strapping devices of this type are also designed to connect only weldable plastic straps to each other.

In mobile devices a low weight is of particular importance in order to put as little physical strain on the user of the strapping device as possible when using the device. Also, for ergonomic reasons the weight of the strapping device should be distributed as evenly as possible, in order to avoid concentration of the weight in the head area of the strapping device. Such concentration results in unfavourable handling properties of the device. As ergonomic and user-friendly handling of the strapping device as possible are always striven for. More particularly the possibility of incorrect use or faulty operation should be minimal.

The aim of the invention is therefore to improve the handling and operating properties of a strapping device of the type set out in the introductory section.

In accordance with the invention this objective is achieved in a mobile strapping device of this type by a means of a common drive for the tensioner for producing a tensioning movement as well as for the friction welder for producing an oscillating friction welding movement and for a transitioning device for bringing about a transfer movement of the friction welder from a rest position into a welding position.

In accordance with the invention a mobile strapping device is provided with a motor-driven tensioner and friction welder. In order to be able to use such as strapping device at least approximately as a hand-held strapping device, it also has a motor-drive transitioning device for the friction welder. In terms of the weight, and in order to avoid a concentration of the weight in the head area of the device, in spite of the high degree of automation of the strapping device in accordance with the invention, all these functional units of the strapping device are driven by just one common drive.

Preferably this just one drive can be designed as an electric motor, the drive movement of which can be used to consecutively drive the tensioner and the friction welder. In an expedient embodiment of the invention means are provided with which a functional connection can be produced either between the just one drive and the tensioner, or between the drive and the friction welder, for example reversing the rotational direction of the motor shaft of the drive.

Preferably with this just one motor not only is the drive movement of the welding procedure itself produced, but also a movement of the friction welder from a rest position into a welding position. In the welding position a welding element of the friction welder is pressed onto the strap layers to be welded to each other and through an oscillating movement produces a friction weld on the strap layers. Here, the welding element is preferably inactive in the rest position and is only started up at the beginning of the movement from the rest position.

The drive of the portable strapping device can preferably be a single electric motor. It has been shown that the motor can advantageously be a brushless direct current motor. Such a motor can be operated in such a way that at different rotational speeds it produces an essentially constant torque.

By using a brushless direct current motor as the drive for the tensioner further advantages can be achieved, as in this way it is possible to control the tensioning procedure in dependence on the rotational speed. For example, in contrast to hitherto possible torques, even a low speeds this allows a comparatively high tensioning device torque. Thus, with such mobile strapping devices it is for the first time possible to place a strap around packaged goods at low speed but towards the end of the tensioning procedure. In previous tensioners, in order to achieve sufficient strap tensioning, the strap had to be moved at high speed at the start of the tensioning procedure, so that the required strap tension can be achieved towards the end of the tensioning procedure. In doing so the strap is whipped against the packaged goods which involves a high risk of damaging the packaged goods. Even sensitive packaged goods can thus be strapped with considerably less danger of damage.

Furthermore, a speed-dependent/speed-controlled tensioning procedure also allows rapid initial tensioning, i.e. tensioning at high strap retraction speed, followed by second tensioning procedure with a reduced strap retraction speed compared with the first tensioning procedure. In such brushless motors, due to the possibility of setting the rotational speed of the motor shaft and the motor torque separately within certain ranges, the strap retraction speeds can be adjusted to the required/desired circumstances during both tensioning procedures. Particularly high strap tensions can be achieved with the described division into a first and at least a second tensioning procedure.

Advantageously at least one planetary gear system is arranged in the force flow between the common drive for the friction welder and for the tensioning device. With regard to the weight of the strapping device and its weight distribution this makes it possible to produce the generally considerably different rotational speeds for the tensioner and the friction welder.

The degree of automation of the strapping device in accordance with the invention can advantageously be improved with as small a number of required components as possible, in that the coordination between the transmission device and friction welder takes place by means of the same single drive. It can be envisaged that the drive motion of the motor is used both as the drive source for the automatic transmission device as well as to achieve the at least approximately synchronous start of the oscillating movement of the friction welder and the transfer movement of the transitioning device. For this a gearing device can be envisaged which transforms the motorised drive movement into different step-down or step-up gear ratios and releases these at two different points, preferably simultaneously, namely at one point for the friction welder and at another point for the transitioning device.

The common gear system device of the friction welder and its transitioning device can advantageously be arranged on a free wheel, which in a certain rotational direction of a drive shaft of the motor transmits the drive movement to the gear system device. Preferably this rotational direction is different from the rotational direction with which the tensioner is operated. It has proven to be beneficial if, seen in the direction of transmission of the drive movement, splitting of the drive movement on the one hand in the direction of the friction welding element of the friction welder, and on the other hand to transitioning device, only takes place after the free wheel. The gear system device can have a first gear section for the friction welder and a second gear section for the transitioning device, whereby both gear sections perform different step-down or step-ups of the drive movement.

It has proven to be particularly advantageous, if in the drive train of the transitioning device, as a component of the gear system device a gear is provided with which a step down ratio in a range of 100:1 to 30:1, preferably 40:1 to 80:1 and particularly preferably 50:1 to 70:1 can be achieved. Such a step-down ratio can be advantageously attained with a planetary fear, more particularly a multiple stage planetary gear. However other types of gear can also be provided, such as bevel gears.

An expedient form of the preferred embodiment of the invention provided with a planetary gear system can be cam controlled, whereby a rotating cam is used for switching the device on and off. It can be envisaged that through mechanical operation the cam brings about a movement of the friction welder from a rest position into a welding position.

An embodiment of the strapping device can also be of independent relevance in which an operating means for the joint operation of the tensioner and the friction welder is provided, by means of which the tensioner and friction welder can be consecutively started up. Here it is preferable if in the strapping device optionally either the tensioner or the friction welder are activated by just one operation of the operating means in order to consecutively perform their functions, or tensioner and friction welder can be operated separately of each other. In joint activation, through a common activation manipulation, for example by pressing just one switch, the tensioner is initially started and after completion of the tensioning procedure, without further manual operation of the device, the welding procedure is automatically started and carried out. On the other hand, in the case of separate operation the user can determine the times at which the tensioner is operated and at which time intervals separate operation of the friction welder is started independently of the tensioner. For this, separate operation of an operating element is envisaged, which then also allows at least largely automated welding procedure to take place.

In a possible further development of the invention an adjustable and operating switch means for both of these modes can be envisaged, with which the operating means are provided with the joint activation function but also with the possibility of independent and separate operation the tensioner and friction welder.

Further preferred embodiments of the invention are set out in the claims, the description and the drawing.

The invention will be described in more detail by way of the examples of embodiment which are shown purely schematically.

Figure 1:
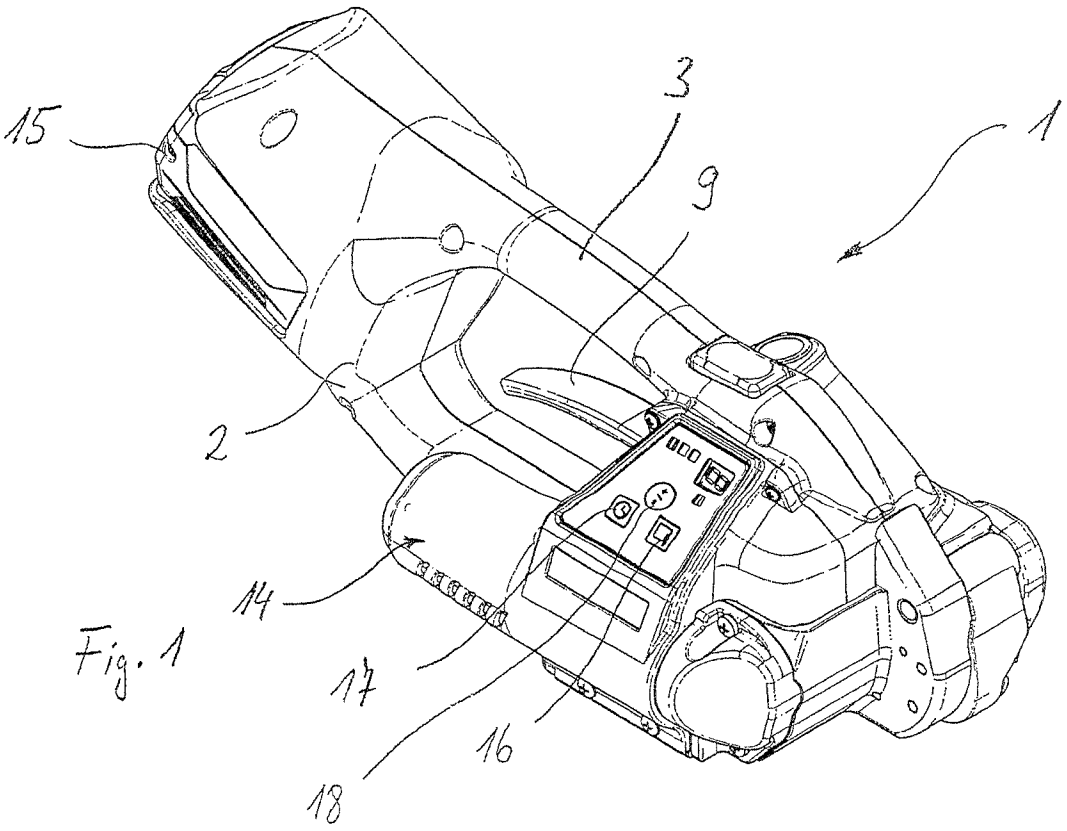
FIG. 1 is a perspective view of a strapping device in accordance with the invention.
Figure 2:
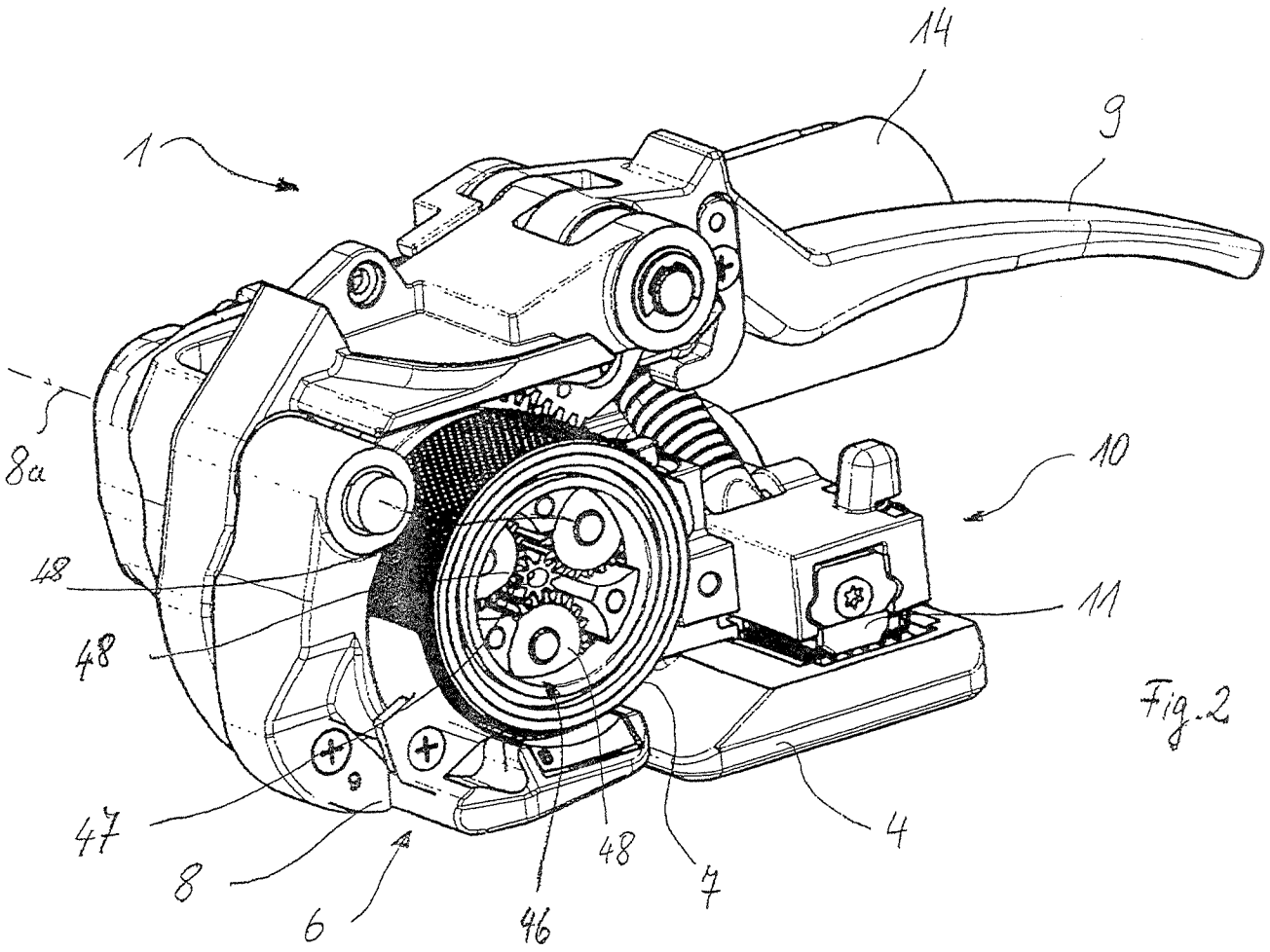
FIG. 2 shows the strapping device in FIG. 1 with the casing.
Figure 10:
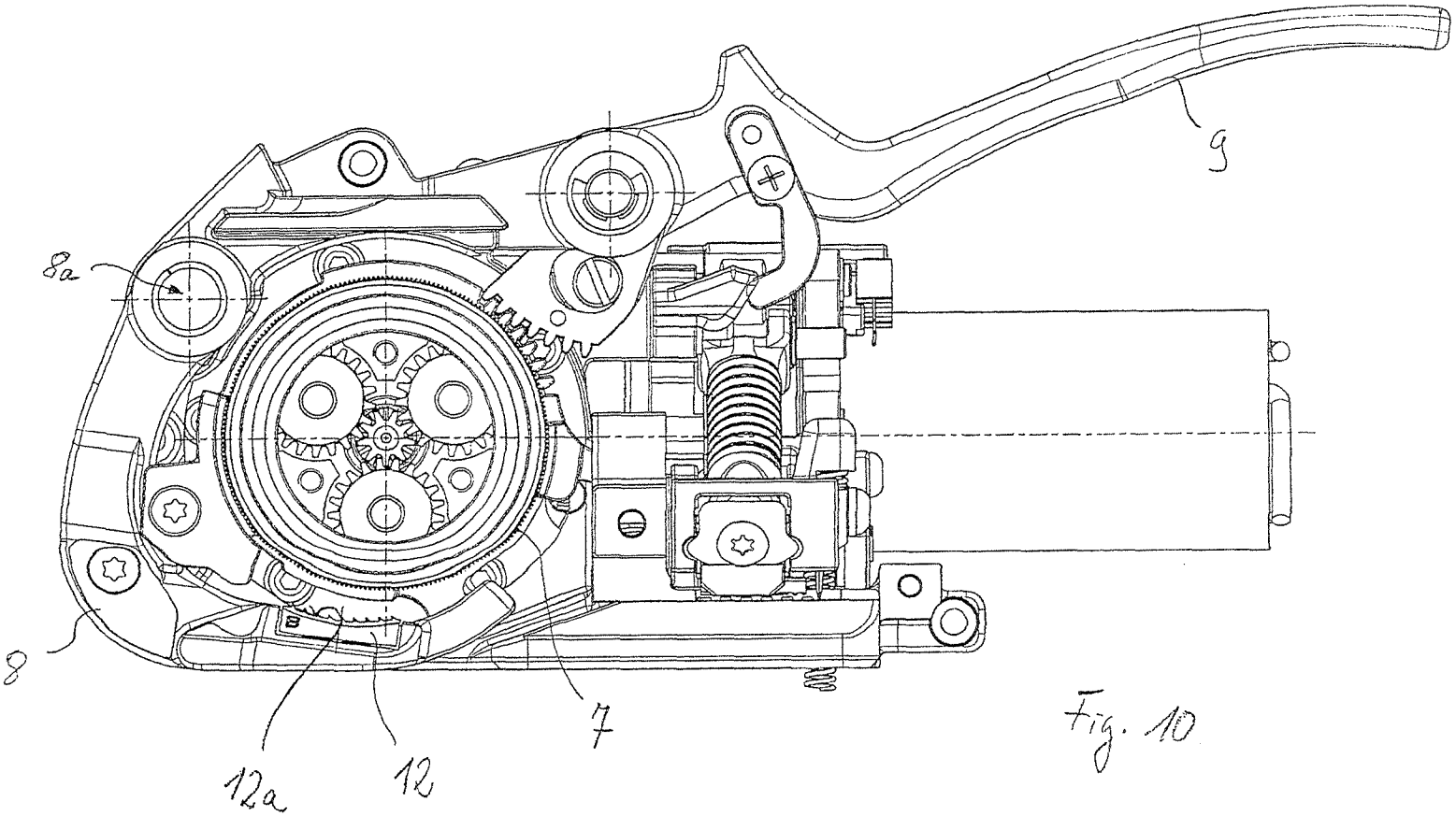
FIG. 10 shows a side view of the tensioner of the strapping device without the casing, in which a tensioning rocker is in a rest position.
Figure 13:
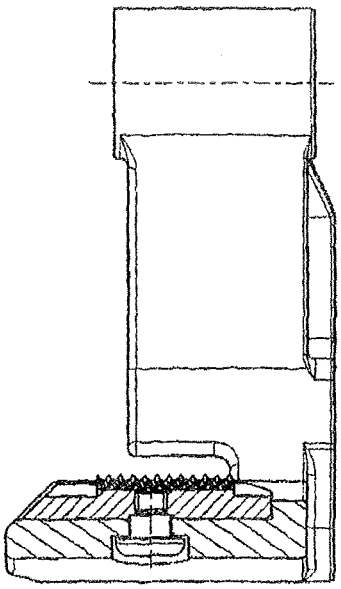
Figure 12:
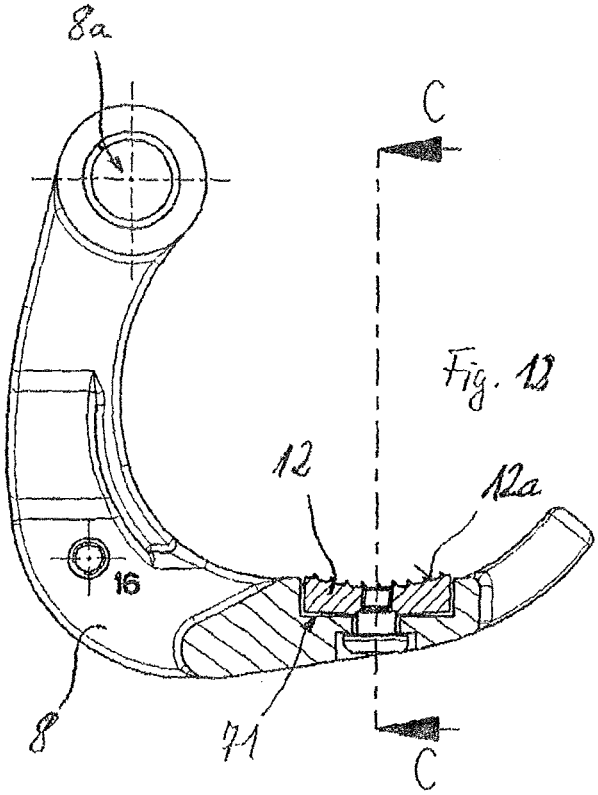
Figure 14:
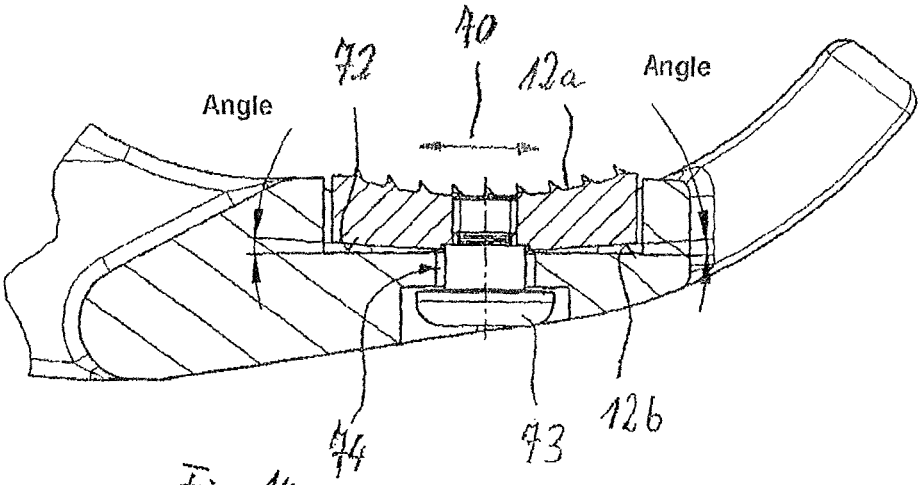

FIG. 12 a side view of the tensioning rocker of the strapping device in FIG. 10 shown in a partial section;

FIG. 13 shows a front view of the tensioning rocker in FIG. 12;

FIG. 14 shows a detail from FIG. 12 along line C-C;

The exclusively manually operated strapping device 1 in accordance with the invention shown in FIGS. 1 and 2 has a casing 2, surrounding the mechanical system of the strapping device, on which a grip 3 for handling the device is arranged. The strapping device also has a base plate 4, the underside of which is intended for placing on an object to be packed. All the functional units of the strapping device 1 are attached on the base place 4 and on the carrier of the strapping device which is connected to the base plate and is not shown in further detail.

With the strapping device 1 a loop of plastic strap, made for example of polypropylene (PP) or polyester (PET), which is not shown in more detail in FIG. 1 and which has previously been placed around the object to be packed, can be tensioned with a tensioner 6 of the strapping device. For this the tensioner has a tensioning wheel 7 with which the strap can be held for a tensioning procedure. The tensioning wheel 7 operates in conjunction with a rocker 8, which by means of a rocker lever 9 can be pivoted from an end position at a distance from the tensioning wheel into a second end position about a rocker pivoting axis 8*a*, in which the rocker 8 is pressed against the tensioning wheel 7. The strap located between the tensioning wheel 7 and the rocker 8 is also pressed against the tensioning wheel 7. By rotating the tensioning wheel 7 it is then possible to provide the strap loop with a strap tension that is high enough for the purpose of packing. The tensioning procedure, and the rocker 8 advantageously designed for this, is described in more detail below.

Subsequently, at a point on the strap loop on which two layers of the wrapping strap are disposed one on top of the other, welding of the two layers can take place by means of the friction welder 8 of the strapping device.

In this way the strap loop can be durably connected. For this the friction welder 10 is provided with a welding shoe 11, which through mechanical pressure on the wrapping strap and simultaneous oscillating movement at a predefined frequencies starts to melt the two layers of the wrapping strap. The plastified or melted areas flow into each other and after cooling of the strap a connection is formed between the two strap layers. If necessary the strap loop can be separated from a strap storage roll by means of a strapping device 1 cutter which is not shown.

Operation of the tensioner 6, assignment of the friction welder 10 by means of a transitioning device (FIG. 6) of the friction welder as well as the operation of the friction welder itself and operation of the cutter all take place using only one common electric motor 14, which provides a drive movement for each of these components. For its power supply, an interchangeable storage battery 15, which can be removed for charging, is arranged on the strapping device. The supply of other external auxiliary energies, such as compressed air or additional electricity, is not envisaged in accordance with FIGS. 1 and 2.

The portable mobile strapping device 1 has an operating element 16, in the form of a press switch, which is intended for starting up the motor. Via a switch 17, three operating modes can be set for the operating element 16. In the first mode by operating the operating element 16, without further action being required by the operator, the tensioner 6 and the friction welder 10 are started up consecutively and automatically. To set the second mode the switch 17 is switched over to a second switching mode. In the second possible operating mode, by operating the operating element 15, only the tensioner 6 is started up. To separately start the friction welder 10 a second operating element 18 must be activated by the operator. In alternative forms of embodiment it can also be envisaged that in this mode the first operating element 16 has to be operated twice in order to activate the friction welder. The third mode is a type of semi-automatic operation in which the tensioning button 16 must be pressed until the tension force/tensile force which can preset in stages is achieved in the strap. In this mode it is possible to interrupt the tensioning process by releasing the tensioning button 16, for example in order to position edge protectors on the goods to be strapped under the wrapping strap. By pressing the tensioning button the tensioning procedure can then be continued. This third mode can be combined with a separately operated as well as an automatic subsequent friction welding procedure.

Figure 3:
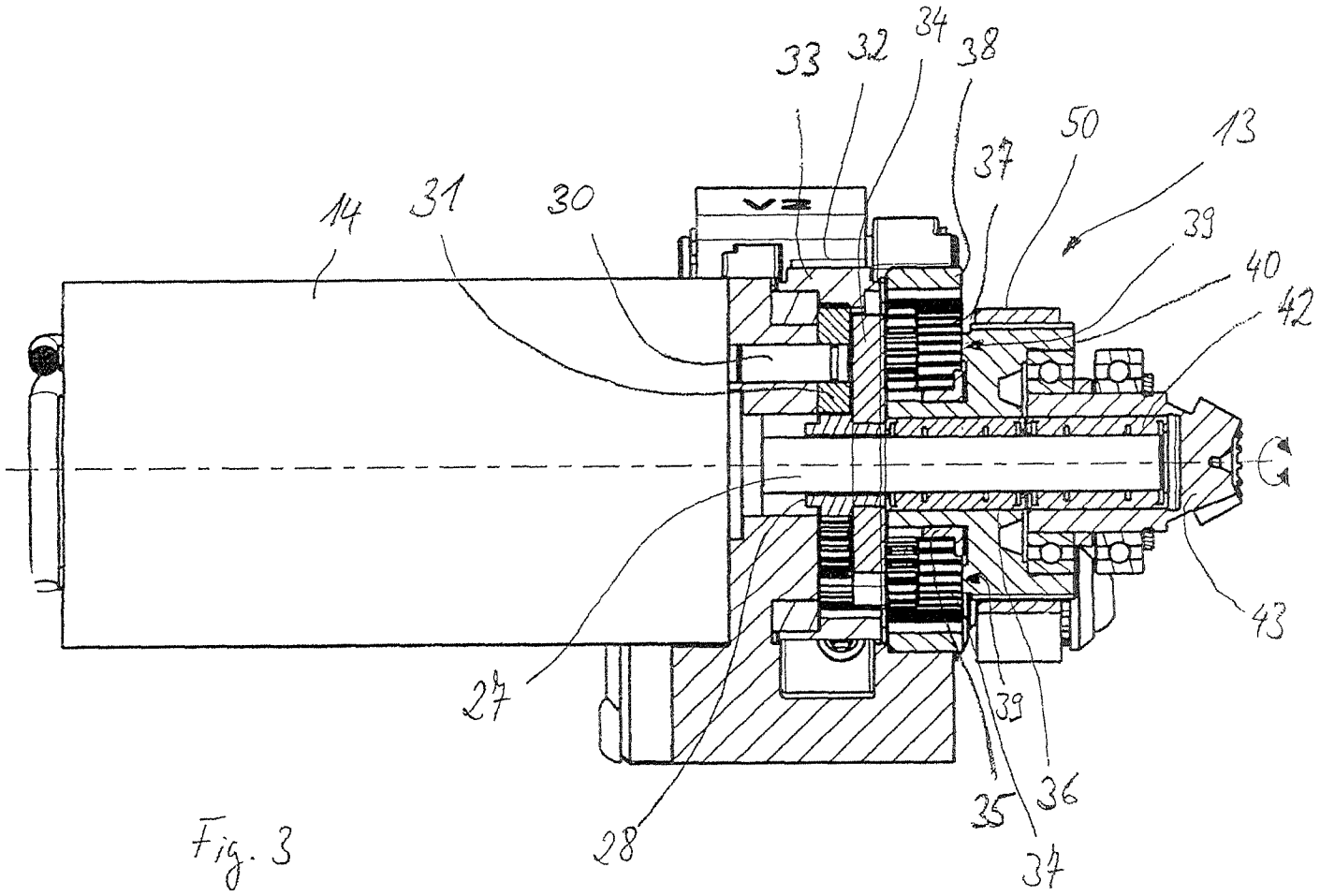
FIG. 3 shows a partial section view of the motor of the strapping device in FIG. 1, together with components arranged on the motor shaft.

On a motor shaft 27, shown in FIG. 3, of the brushless, grooved rotor direct current motor 14 a gearing system device 13 is arranged. In the example of embodiment shown here a type EC140 motor manufactured by Maxon Motor AG, Brünigstrasse 20, 6072 Sachseln is used. The brushless direct current motor 14 can be operated in both rotational directions, whereby one direction is used as the drive movement of the tensioner 6 and the other direction as the drive movement of the welding device 10.

Figure 4:
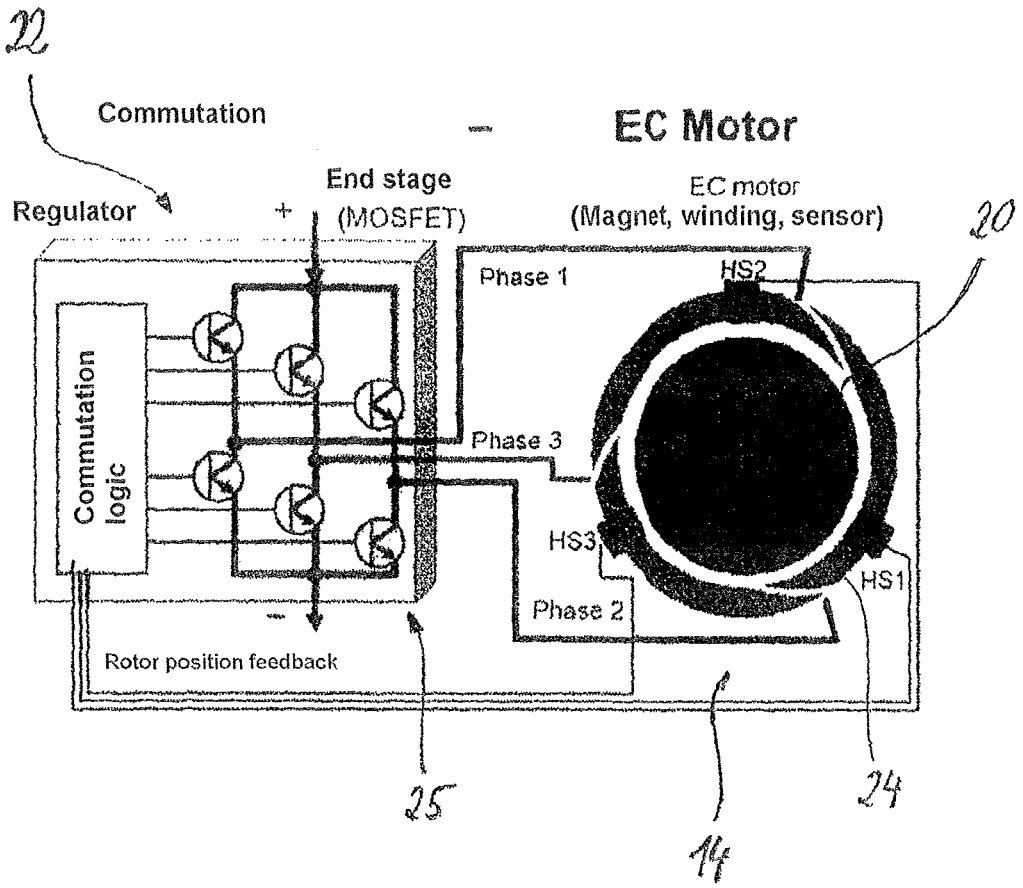
FIG. 4 shows a very schematic view of the motor along with its electronic commutation switch.

The brushless direct current motor 14, shown purely schematically in FIG. 4, is designed with a grooved rotor 20 with three Hall sensors HS1, HS2, HS3. In its rotor 20, this EC motor (electronically commutated motor) has a permanent magnet and is provided with an electronic control 22 intended for electronic commutation in the stator 24. Via the Hall sensors, HS1, HS2, HS3, which in the example of embodiment also assume the function of position sensors, the electronic control 22 determines the current position of the rotor and controls the electrical magnetic field in the windings of the stator 24. The phases (phase 1, phase 2, phase 3) can thus be controlled depending in the position of the rotor 20, in order to bring about a rotational movement of the rotor in a particular rotational direction with a predeterminable variable rotational speed and torque. In this present case a "1$^{st}$ quadrant motor drive intensifier" is used, which provides the motor with the voltage as well as peak and continuous current and regulates these. The current flow for coil windings of the stator 24, which are not shown in more detail, is controlled via a bridge circuit 25 (MOSFET transistors), i.e. commutated. A temperature sensor, which is not shown in more detail, is also provided on the motor. In this way the rotational direction, rotational speed, current limitation and temperature can be monitored and controlled. The commutator is designed as a separate print component and is accommodated in the strapping device separately from the motor.

The power supply is provided by the lithium-ion storage battery 15. Such storage batteries are based on several independent lithium ion cells in each of which essentially separate chemical processes take place to generate a potential difference between the two poles of each cell. In the example of embodiment the lithium ion storage battery is manufactured by Robert Bosch GmbH, D-70745 Leinfelden-Echterdingen. The battery in the example of embodiment has eight cells and has a capacity of 2.6 ampere-hours. Graphite is used as the active material/negative electrode of the lithium ion storage battery. The positive electrode often has lithium metal oxides, more particularly in the form of layered structures. Anhydrous salts, such as lithium hexafluorophosphate or polymers are usually used as the electrolyte. The voltage emitted by a conventional lithium ion storage battery is usually 3.6 volts. The energy density of such storage batteries is around 100 Wh/kh-120 Wh/kg.

On the motor side drive shaft, the gearing system device 13 has a free wheel 36, on which a sun gear 35 of a first planetary gear stage is arranged. The free wheel 36 only transfers the rotational movement to the sun gear 35 in one of the two possible rotational directions of the drive. The sun gear 35 meshes with three planetary gears 37 which in a known manner engage with a fixed gear 38. Each of the planetary gears 37 is arranged on a shaft 39 assigned to it, each of which is connected in one piece with an output gear 40. The rotation of the planetary gears 37 around the motor shaft 27 produces a rotational movement of the output gear 40 around the motor shaft 27 and determines a rotational speed of this rotational movement of the output gear 40. In addition to the sun gear 35 the output gear 40 is also on the free wheel 36 and is therefore also arranged on the motor shaft. This free wheel 36 ensures that both the sun gear 35 and the output gear 40 only also rotate in one rotational direction of the rotational movement of the motor shaft 27. The free wheel 29 can for example be of type INA HFL0615 as supplied by the company Schaeffler KG, D-91074 Herzogenaurach, On the motor-side output shaft 27 the gear system device 13 also has a toothed sun gear 28 belonging to a second planetary gear stage, through the recess of which the shaft 27 passes, though the shaft 27 is not connected to the sun gear 28. The sun gear is attached to a disk 34, which in turn is connected to the planetary gears. The rotational movement of the planetary gears 37 about the motor-side output shaft 27 is thus transferred to the disk 34, which in turn transfers its rotational movement at the same speed to the sun gear 28. With several planetary gears, namely three, the sun gear 28 meshes with cog gears 31 arranged on a shaft 30 running parallel to the motor shaft 27. The shafts 30 of the three cog gears 31 are fixed, i.e. they do not rotate about the motor shaft 27. In turn the cog gears 21 engage with an internal-tooth sprocket, which on its outer side has a cam 32 and is hereinafter referred to as the cam wheel 33. The sun gear 28, the three cog gears 31 as well as the cam wheel 33 are components of the second planetary gear stage. In the planetary gear system the input-side rotational movement of the shaft 27 and the rotational movement of the cam wheel are at a ratio of 60:1, i.e. a 60-fold reduction takes place through the second-stage planetary gear system.

At the end of the motor shaft 27, on a second free wheel 42 a bevel gear 43 is arranged, which engages in a second bevel gear, which is not shown in more detail. This free wheel 42 also only transmits the rotational movement in one rotational direction of the motor shaft 27. The rotational direction in which the free wheel 36 of the sun gear 35 and the free wheel 42 transmit the rotational movement of the motor shaft 27 is opposite. This means that in one rotational direction only free wheel 36 turns, and in the other rotational direction only free wheel 42.

The second bevel gear is arranged on one of a, not shown, tensioning shaft, which at its other end carries a further planetary gear system 46 (FIG. 2). The drive movement of the electric motor in a particular rotational direction is thus transmitted by the two bevel gears to the tensioning shaft. Via a sun gear 47 as well as three planetary gears 48 the tensioning wheel 49, in the form of an internally toothed sprocket, of the tensioner 6 is rotated. During rotation the tensioning wheel 7, provided with a surface structure on its outer surface, moves the wrapping strap through friction, as a result of which the strap loop is provided with the envisaged tension.

Figure 5:
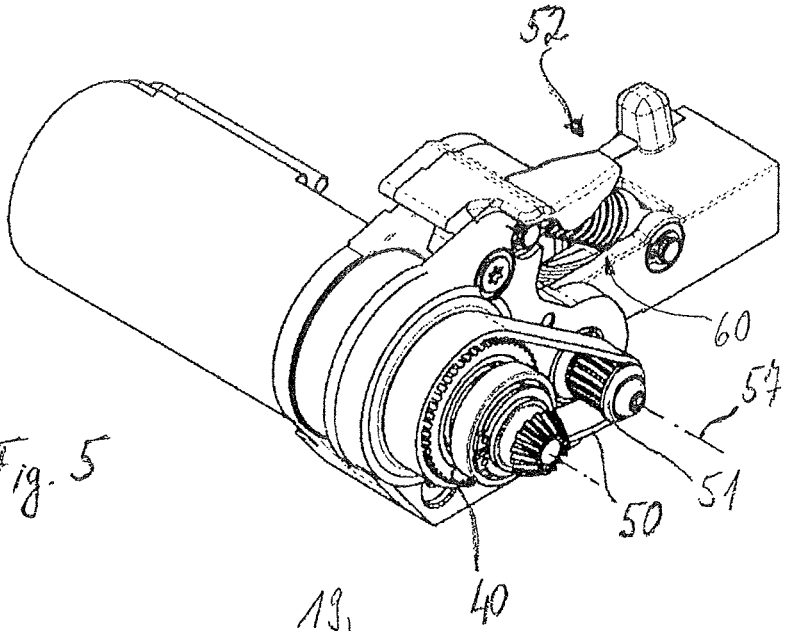
FIG. 5 shows a perspective partial view of the drive train of the strapping device in FIG. 1.
Figure 6:
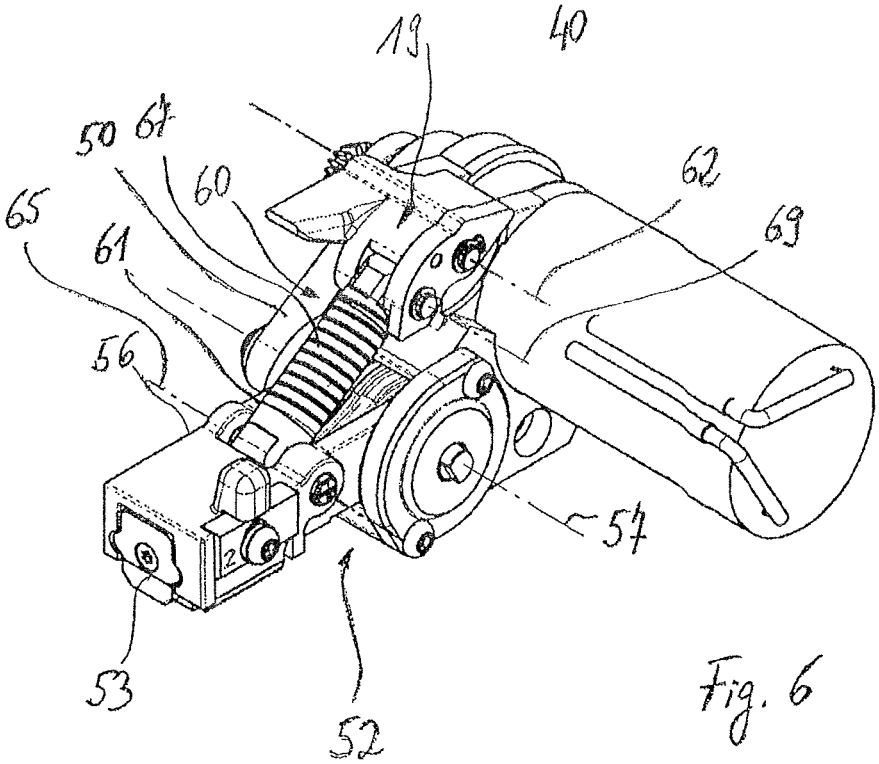
FIG. 6 shows the drive train in FIG. 5 from another direction of view.

In the area of its outer circumference the output gear 40 is designed as a cog gear on which is a toothed belt of an envelope drive (FIGS. 5 and 6). The toothed belt 50 also goes round pinion 51, smaller in diameter than the output gear 40, the shaft of which drive an eccentric drive 52 for producing an oscillating to and fro movement of the welding shoe 53. Instead of toothed belt drive any other form of envelope drive could be provided, such as a V-belt or chain drive. The eccentric drive 52 has an eccentric shaft 54 on which an eccentric tappet 55 is arranged on which in turn a welding shoe arm 56 with a circular recess is mounted. The eccentric rotational movement of the eccentric tappet 55 about the rotational axis 57 of the eccentric shaft 54 results in a translator oscillating to and fro movement of the welding shoe 53. Both the eccentric drive 52 as well as the welding shoe 53 it can be designed in any other previously known manner.

Figure 9:
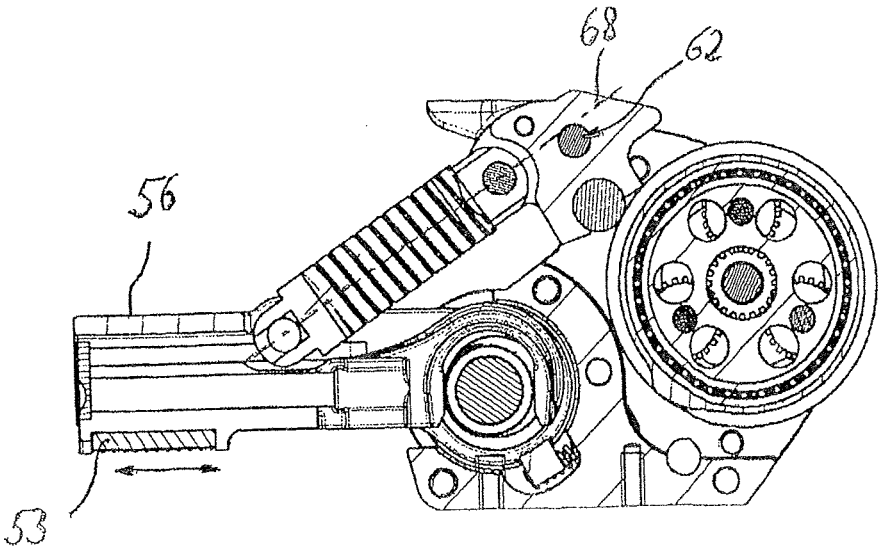
FIG. 9 shows a side view of the drive train in FIG. 5 with the welding device in a welding position.

The welding device is also provided with a toggle lever device 60, by means of which the welding device can be moved from a rest position (FIG. 7) into a welding position (FIG. 9). The toggle lever device 60 is attached to the welding shoe arm 56 and provided with a longer toggle lever 61 pivotably articulated on the welding shoe arm 56. The toggle lever device 60 is also provided with a pivoting element 63, pivotably articulated about a pivoting axis 62, which in the toggle level device 60 acts as the shorter toggle lever. The pivoting axis 62 of the pivoting element 63 runs parallel to the axes of the motor shaft 27 and the eccentric shaft 57.

Figure 7:
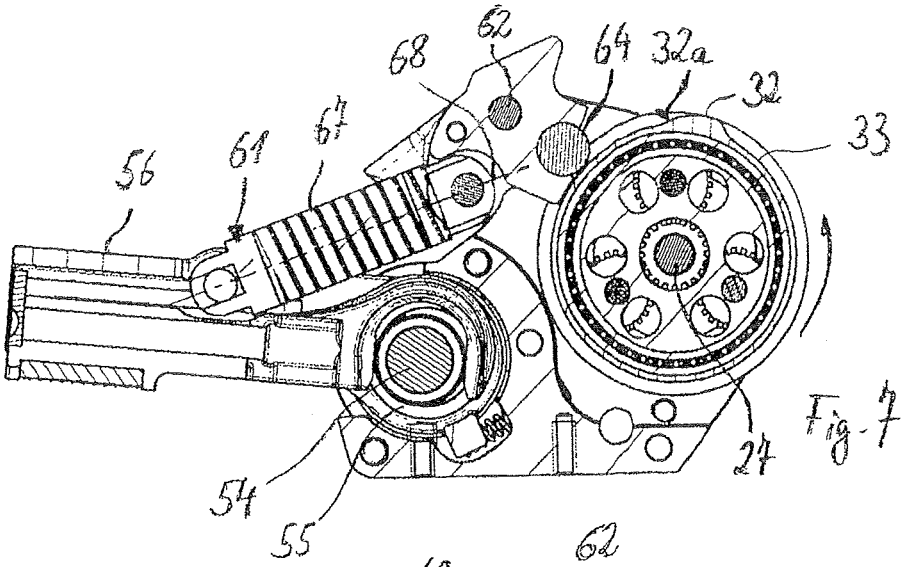
FIG. 7 shows a side view of the drive train in FIG. 5 with the welding device in the rest position.
Figure 8:
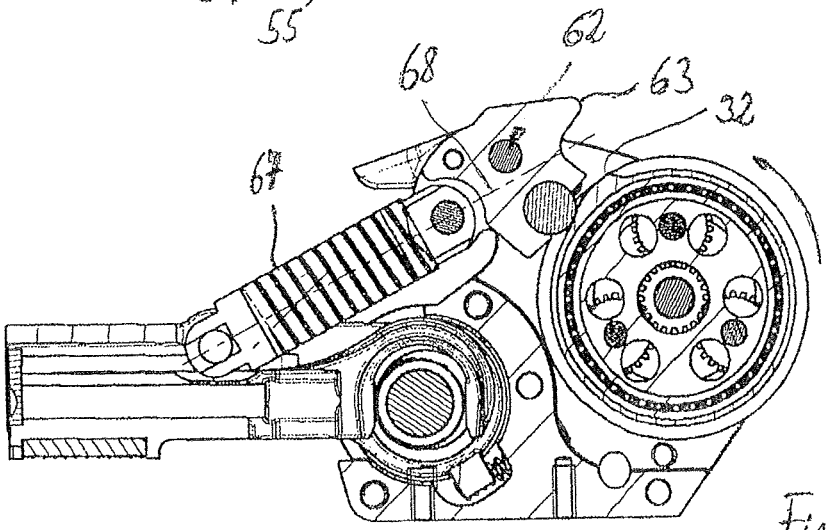
FIG. 8 shows a side view of the drive train in FIG. 6 with the welding device in a position between two end positions.

The pivoting movement is initiated by the cam 32 on the cam wheel 33 which during rotational movement in the anti-clockwise direction—in relation to the depictions in FIGS. 7 to 9—of the cam wheel 33 ends up under the pivoting element 63 (FIG. 8). A ramp-like ascending surface 32*a* of the cam 32 comes into contact with a contact element 64 set into the pivoting element 63. The pivoting element 63 is thus rotated clockwise about its pivoting axis 62. In the area of a concave recess of the pivoting element 63 a two-part longitudinally-adjustable toggle lever rod of the toggle lever 61 is pivotably arranged about a pivoting axis 69 in accordance with the 'piston cylinder' principle. The latter is also rotatably articulated on an articulation point 65, designed as a further pivoting axis 65, of the welding shoe arm 56 in the vicinity of the welding shoe 53 and at a distance from the pivoting axis 57 of the welding shoe arm 56. Between both ends of the longitudinally adjustable toggle lever rod a pressure spring 67 is arranged thereon, by means of which the toggle lever 61 is pressed against both the welding shoe arm 56 as well as against the pivoting element 63. In terms of its pivoting movements the pivoting element 63 is thus functionally connected to the toggle lever 61 and the welding shoe arm 56.

As can be seen in the depictions in FIG. 7, in the rest position there is an (imaginary) connecting line 68 for both articulation points of the toggle lever 61 running through the toggle lever 61 between the pivoting axis 62 of the pivoting element 63 and the cam wheel 33, i.e. on one side of the pivoting axis 62. By operating the cam wheel 33 the pivoting element 63 is rotated clockwise—in relation to the depictions in FIGS. 7 to 9. In this way the toggle lever 61 of the pivoting 63 is also operated. In FIG. 8 an intermediate position of the toggle lever 61 is shown in which the connecting line 68 of the articulation points 65, 69 intersects the pivoting axis 62 of the pivoting element 63. In the end position of the movement (welding position) shown in FIG. 9 the toggle lever 61 with its connecting line 68 is then on the other side of the pivoting axis 62 of the pivoting element 63 in relation to the cam wheel 33 and the rest position. During this movement the welding arm shoe 56 is transferred by the toggle lever 61 from its rest position into the welding position by rotation about the pivoting axis 57. In the latter position the pressure spring 67 presses the pivoting element 63 against a stop, not shown in further detail, and the welding shoe 53 onto the two strap layers to be welded together. The toggle lever 61, and therefore also the welding shoe arm 56, is thus in a stable welding position.

The anticlockwise drive movement of the electric motor shown in FIGS. 6 and 9 is transmitted by the toothed belt 50 to the welding shoe 53, brought into the welding position by the toggle lever device 60, which is pressed onto both strap layer and moved to and fro in an oscillating movement. The welding time for producing a friction weld connection is determined by way of the adjustable number of revolutions of the cam wheel 33 being counted as of the time at which the cam 32 operates the contact element 64. For this the number of revolutions of the shaft 27 of the brushless direct current motor 14 is counted in order to determine the position of the cam wheel 33 as of which the motor 14 should switch off and thereby end the welding procedure. It should be avoided that on switching off the motor 14 the cam 32 comes to a rest under the contact element 64. Therefore, for switching off the motor 14 only relative positions of the cam 32 with regard to the pivoting element 63 are envisaged, a which the cam 32 is not under the pivoting element. This ensures that the welding shoe arm 56 can pivot back from the welding position into the rest position (FIG. 7). More particularly, this avoids a position of the cam 32 at which the cam 32 would position the toggle lever 61 at a dead point, i.e. a position in which the connecting line 68 of the two articulation points intersects the pivoting axis 62 of the pivoting element 63—as shown in FIG. 8. As such a position is avoided, by means of operating the rocker lever the rocker (FIG. 2) can be released from the tensioning wheel 7 and the toggle lever 61 pivoted in the direction of the cam wheel 33 into the position shown in FIG. 7. After the strap loop has been taken out of the strapping device, the latter is ready for a further strapping procedure.

The described consecutive procedures "tensioning" and "welding" can be jointly initiated in one switching status of the operating element 15. For this the operating element 16 is operated once, whereby the electric motor 14 first turns on the first rotational direction and thereby (only) the tensioner 6 is driven. The strap tension to be applied to the strap can be set on the strapping device, preferably be means of a push button in nine stages, which correspond to nine different strap tensions. Alternatively continuous adjustment of the strap tension can be envisaged. As the motor current is dependent on the torque of the tensioning wheel 7, and this in turn on the current strap tension, the strap tension to be applied can be set via push buttons in nine stages in the form of a motor current limit value on the control electronics of the strapping device.

After reaching a settable and thus predeterminable limit value for the motor current/strap tension, the motor 14 is switched off by its control device 22. Immediately afterwards the control device 22 operates the motor in the opposite rotational direction. As a result, in the manner described above, the welding shoe 52 is lowered onto the two layers of strap displaced one on top of the other and the oscillating movement of the welding shoe is carried out to produce the friction weld connection.

By operating switch 17 the operating element 16 can only activate the tensioner. If this is set, by operating the operating element only the tensioner is brought into operation and on reaching the preset strap tension is switched off again. To start the friction welding procedure the second operating element 18 must be operated. However, apart from separate activation, the function of the friction welding device is identical the other mode of the first operating element.

Figure 11:
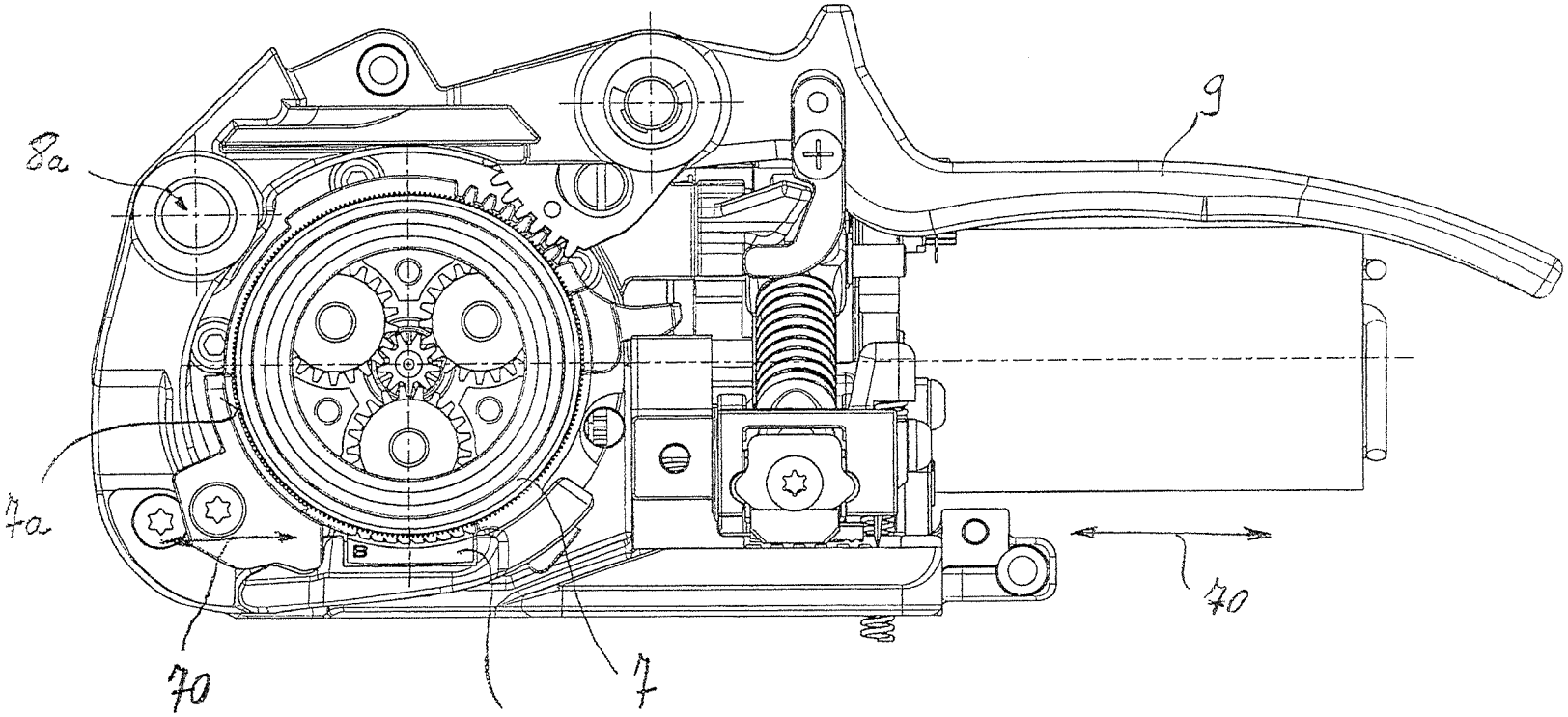
FIG. 11 shows a side view of the tensioner of the strapping device without the casing in which a tensioning rocker is in a tensioning position.

As has already been explained, the rocker 8 can through operating the rocker lever 9 shown in FIGS. 2, 10, 11 carry out pivoting movements about the rocker axis 8*a*. For this, the rocker is moved by a rotating cam disc which is behind the tensioning wheel 7 and cannot therefore be seen in FIG. 2. Via the rocker lever 9 the cam disc can carry out a rotational movement of approx. 30° and move the rocker 8 and/or the tensioning plate 12 relative to the tensioning wheel 7 which allow the strap to be inserted into the strapping device/between the tensioning wheel 7 and tensioning plate 12.

In this way, the toothed tensioning plate arranged on the free end of the rocker can be pivoted from a rest position shown in FIG. 10 into a tensioning position shown in FIG. 11 and back again. In the rest position the tensioning plate 12 is at sufficiently great distance from the tensioning wheel 7 that a wrapping strap can be placed in two layers between the tensioning wheel and the tensioning plate as required for producing connection on a strap loop. In the tensioning position the tensioning plate 12 is pressed in a known way, for example by means of a spring force acting on the rocker, against the tensioning wheel 7, whereby, contrary to what is shown in FIG. 11, in a strapping procedure the two-layer strap is located between the tensioning plate and the tensioning wheel and thus there should be no contact between the two latter elements. The toothed surface 12*a* (tensioning surface) facing the tensioning wheel 7 is concavely curved whereby the curvature radius corresponds with the radius of the tensioning wheel 7 or is slightly larger.

As can be seen in particular in FIGS. 10 and 11 as well as the detailed drawings of FIGS. 12-14, the toothed tensioning plate 12 is arranged in a grooved recess 71 of the rocker. The length—in relation to the direction of the strap—of the recess 71 is greater than the length of the tensioning plate 12. In addition, the tensioning plate 12 is provide with a convex contact surface 12*b* with which it is arranged on a flat contact surface 71 in the recess 71 of the rocker 8. As shown in particular in FIGS. 11 and 12 the convex curvature runs in a direction parallel to the strap direction 70, while the contact surface 12*b* is designed flat and perpendicular to this direction (FIG. 13). As a result of this design the tensioning plate 12 is able to carry out pivoting movements in the strap direction 70 relative to the rocker 8 and to the tensioning wheel 7. The tensioning plate 12 is also attached to the rocker 8 by means of a screw 72 passing through the rocker from below. This screw is in an elongated hole 74 of the rocker, the longitudinal extent of which runs parallel to the course of the strap 70 in the strapping device. As a result in addition to be pivotable, the tensioning plate 12 is also arranged on the rocker 8 in a longitudinally adjustable manner.

In a tensioner the tensioning rocker 8 is initially moved from the rest position (FIG. 10) into the tensioning position (FIG. 11). In the tensioning position the sprung rocker 8 presses the tensioning plate in the direction of the tensioning wheel and thereby clamps the two strap layers between the tensioning wheel 7 and the tensioning plate 12. Due to different strap thicknesses this can result in differing spacings between the tensioning plate 12 and circumferential surface 7*a* of the tensioning wheel 7. This not only results in different pivoting positions of the rocker 8, but also different positions of the tensioning plate 12 in relation to the circumferential direction of the tensioning wheel 7. In order to still achieve uniform pressing conditions, during the pressing procedure the tensioning plate 12 adjusts itself to the strap through a longitudinal movement in the recess 71 as well as a pivoting movement via the contact surface 12*b* on contact surface 72 so that the tensioning plate 12 exerts as even a pressures as possible over its entire length on the wrapping strap. If the tensioning wheel 7 is then switched on the toothing of tensioning plate 12 holds the lower strap layer fast, while the tensioning wheel 7 grasps the upper strap layer with its toothed circumferential surface 7*a*. The rotational movement of the tensioning wheel 7 as well the lower coefficient of friction between the two strap layers then results in the tensioning wheel pulling back the upper band layer, thereby increasing the tension in the strap loop up to the required tensile force value.

LIST REFERENCES

| | |
|---|---|
| 1. | Strapping device 1 |
| 2. | Casing |
| 3. | Grip |
| 4. | Base plate |
| 6. | Tensioner |
| 7. | Tensioning wheel |
| 7a. | Circumferential surface |
| 8. | Rocker |
| 8. | Rocker pivoting axis |
| 9. | Rocker lever |
| 10. | Friction welder |
| 11. | Welding shoe |
| 12. | Tensioning plate |
| 12a. | Tensioning surface |
| 12b. | Contact surface |
| 13. | Gear system device |
| 14. | Electric direct current motor |
| 15. | Storage battery |
| 16. | Operating element |
| 17. | Switch |
| 18. | Operating element |
| 19. | Transmission device |
| 20. | Rotor |
| HS1 | Hall sensor |
| HS2 | Hall sensor |
| HS3 | Hall sensor |
| 22. | Electronic control |
| 24. | Stator |

-continued

| | |
|---|---|
| 25. | Bridging cicuit |
| 27. | Motor side output shaft |
| 28. | Sun gear |
| 30. | Shaft |
| 31. | Cog wheel |
| 32. | Cam |
| 32a. | Surface |
| 33. | Cam wheel |
| 35. | Sun gear |
| 36. | Free wheel |
| 37. | Planetary gear |
| 38. | Socket |
| 39. | Shaft |
| 40. | Output gear |
| 42. | Free wheel |
| 43. | Bevel gear |
| 46. | Planetary gear system |
| 47. | Sun gear |
| 48. | Planetary gear |
| 49. | Tensioning wheel |
| 50. | Toothed belt |
| 51. | Pinion |
| 52. | Eccentric drive |
| 53. | Welding shoe |
| 54. | Eccentric shaft |
| 55. | Eccentric tappet |
| 56. | Welding shoe arm |
| 57. | Rotational axis eccentric shaft |
| 60. | Toggle lever device |
| 61. | Longer toggle lever |
| 62. | Pivoting axis |
| 63. | Pivoting element |
| 64. | Contact element |
| 65. | Pivoting axis |
| 66. | Pivoting axis |
| 67. | Pressure spring |
| 68. | Connecting line |
| 69. | Pivoting axis |
| 70. | Strap direction |
| 71. | Recess |
| 72. | Contact surface |
| 73. | Screw |
| 74. | Elongated hole |

The invention claimed is:

1. A mobile strapping device for strapping packaged goods with a loop of wrapping strap, the mobile strapping device comprising:

a tensioner configured to apply a strap tension to the loop of wrapping strap;

a friction welder configured to produce a friction weld connection by way of a friction welding element at two areas of the loop of wrapping strap disposed one on top of the other;

a common drive for the tensioner for producing a tensioning movement, for the friction welder for producing an oscillating friction welding movement, and for a transitioning device for producing a transfer movement of the friction welder from a rest position into a welding position, wherein the common drive drives the tensioner when the common drive is rotated in a first direction and drives the friction welder and the transitioning device when the common drive is rotated in a second different direction;

a chargeable energy storage device configured to store energy that can be released as drive energy for motorized drive motions of the common drive; and a planetary gear system configured to change and transfer a drive movement of the common drive to the transitioning device to produce the transfer movement.

2. The mobile strapping device in accordance with claim 1 wherein the common drive includes a drive shaft that can be functionally connected to the tensioner, the friction welder, and the transitioning device.

3. The mobile strapping device in accordance with claim 1, wherein the friction welder and the transitioning device can be driven in the same rotational direction as the common drive.

4. The mobile strapping device in accordance with claim 1, which includes a free wheel that is only functionally connected to the common drive in one rotational direction of the common drive for transmitting the drive movement of the common drive, whereby in this rotational direction the friction welder and the transitioning device can be functionally connected to the free wheel.

5. The mobile strapping device in accordance with claim 1, wherein the planetary gear system is configured to change and transfer the drive movement of the common drive to the friction welder.

6. The mobile strapping device in accordance with claim 1, wherein the planetary gear system is configured to step down a drive movement provided by the common drive by a ratio in the range 30:1 to 100:1.

7. The mobile strapping device in accordance with claim 1, wherein the tensioner and the friction welder can be jointly operated and started up consecutively.

8. The mobile strapping device in accordance with claim 7, wherein the mobile strapping device is operable in at least two switching statuses, whereby in one switching status the tensioner and friction welder can be jointly operated, and in the second switching status the tensioner and friction welder can be operated separately.

9. The mobile strapping device in accordance with claim 1, wherein the common drive includes a brushless direct current motor.

10. The mobile strapping device in accordance with claim 1, wherein the friction welder is provided with a toggle lever which can be pivoted between two end positions, whereby one end position of the toggle lever determines the welding position and the other end position the rest position in which the friction welder is not in use.

11. The mobile strapping device in accordance with claim 10 wherein the planetary gear system is configured to move the toggle lever from the rest position into the welding position by transferring the drive movement of the common drive to the toggle lever.

12. The mobile strapping device in accordance with claim 1, characterized by a rotational speed-controlled tensioning cycle of the tensioner, during which the common drive is at least at times operated at different rotational speeds at an at least essentially constant torque.

13. The mobile strapping device in accordance with claim 1, wherein the energy storage device is configured to store electrical, mechanical or potential energy.

14. The mobile strapping device in accordance with claim 1, wherein the planetary gear system is configured to step down the drive movement of the common drive by a ratio in the range of 40:1 to 80:1.

15. The mobile strapping device in accordance with claim 1, wherein the planetary gear system is configured to step down the drive movement of the common drive by a ratio in the range of 50:1 to 70:1.

16. The mobile strapping device in accordance with claim 1, wherein the mobile strapping device is configured such that a rotational force from the common drive imparts a force on a toggle lever device, thereby producing the transfer movement of the friction welder, that drives the friction welder from the rest position into the welding position.

17. The mobile strapping device in accordance with claim 1, wherein the mobile strapping device is configured such that a rotational force from the common drive imparts a moment onto a component, thereby rotating the component, wherein the component is linked to the friction welder such that the rotation of the component drives the friction welder from the rest position into the welding position.

18. The mobile strapping device in accordance with claim 1, wherein the mobile strapping device is configured such that a rotational force from the common drive imparts a force onto a first arm of a toggle lever device, which is linked to a second arm of the toggle lever device, which in turn is coupled to the friction welder, such that the first arm moves from a first position, owing to the imparted force onto the first arm, where the friction welder is at the rest position towards a second position where the friction welder is at the welding position, the movement from the first position towards the second position driving the friction welder from the rest position towards the welding position, the movement from the first position towards the second position thereby producing the transfer movement of the friction welder.

19. The mobile strapping device in accordance with claim 1, wherein the mobile strapping device is configured such that the common drive imparts force onto a device such that the force is mechanically communicated from the common drive to the friction welder, thereby producing the transfer movement of the friction welder.

20. The mobile strapping device in accordance with claim 1, wherein the mobile strapping device includes a toggle lever device that transfers force from the common drive to the friction welder, thereby producing the transfer movement of the friction welder by moving the toggle lever.

21. The mobile strapping device in accordance with claim 1, wherein the mobile strapping device includes a toggle lever device that transfers force from the common drive to the friction welder, thereby producing the transfer movement of the friction welder by moving the toggle lever from a position where arms of the toggle lever device are inflected towards a position where the arms of the toggle lever device are parallel.

22. A mobile strapping device for strapping packaged goods with a loop of wrapping strap, the mobile strapping device comprising:

a tensioner configured to apply a strap tension to the loop of wrapping strap;

a friction welder configured to produce a friction weld connection by way of a friction welding element at two areas of the loop of wrapping strap disposed one on top of the other;

a transitioning device operatively connected to the friction welder and configured to move the friction welder from a rest position into a welding position, the transitioning device including a toggle lever device having a first arm and a second arm connected to the first arm; and a chargeable energy storage device configured to store energy, which can be released as drive energy for motorized drive motions at least for the friction welder for producing a friction weld connection, characterized by a common drive for the tensioner for producing a tensioning movement, for the friction welder for producing an oscillating friction welding movement, and for the transitioning device for producing a transfer movement of the friction welder from the rest position into the welding position, wherein the common drive drives the tensioner when the common drive is rotated in a first direction and the common drive drives the friction welder and the transitioning device when the common drive is rotated in a second different direction, wherein the mobile strapping device is configured such that: (i) force from the common drive is transferred to the first arm of the toggle lever device, thereby imparting movement in one of a clockwise direction and a counterclockwise direction; and (ii) the movement of the first arm causes the second arm of the toggle lever device to move in the other of the clockwise direction and the counterclockwise direction, which movement of the second arm produces the transfer movement of the friction welder.

23. A mobile strapping device comprising:

a tensioner configured to apply a strap tension to a loop of wrapping strap;

a friction welder configured to produce a friction weld connection by way of a friction welding element at two areas of the loop of wrapping strap disposed one on top of the other;

a transitioning device operatively connected to the friction welder;

a common drive for the friction welder for producing an oscillating friction welding movement, for the tensioner for producing a tensioning movement without producing the oscillating friction welding movement, and for the transitioning device for producing a transfer movement of the friction welder from a rest position into a welding position; and a planetary gear system operatively coupled to the common drive and the friction welder such that the planetary gear system can change and transfer a rotational speed of the common drive to the friction welder for producing the oscillating friction welding movement.

* * * * *